US006715646B2

(12) United States Patent
Suffa

(10) Patent No.: US 6,715,646 B2
(45) Date of Patent: Apr. 6, 2004

(54) TILTING NOZZLE CAP WHICH CAN BE ALLOCATED TO A CONTAINER

(75) Inventor: Udo Suffa, Gefell/OT Rottmar (DE)

(73) Assignee: Alpla-Werke Alwin Lehner GmbH & Co. KG, Hard (AT)

( * ) Notice: Subject to any disclaimer, the term of this patent is extended or adjusted under 35 U.S.C. 154(b) by 90 days.

(21) Appl. No.: 10/048,723

(22) PCT Filed: May 3, 2001

(86) PCT No.: PCT/EP01/04986

§ 371 (c)(1),
(2), (4) Date: Jul. 16, 2002

(87) PCT Pub. No.: WO01/94230

PCT Pub. Date: Dec. 13, 2001

(65) Prior Publication Data

US 2003/0071057 A1 Apr. 17, 2003

(30) Foreign Application Priority Data

Jun. 2, 2000 (DE) ..... 100 27 489

(51) Int. Cl.[7] ..... B67B 5/00

(52) U.S. Cl. ..... 222/153.06; 222/153.14; 215/253

(58) Field of Search ..... 222/153.06, 153.09, 222/153.1, 153.14; 220/315, 324; 215/202, 203, 216, 250, 253

(56) References Cited

U.S. PATENT DOCUMENTS

| | | | | |
|---|---|---|---|---|
| 3,221,952 A | | 12/1965 | Peter | |
| 3,506,165 A | | 4/1970 | Beard | |
| 4,424,910 A | * | 1/1984 | Heinol | 215/216 |
| 4,711,372 A | | 12/1987 | Gach | |
| 4,884,705 A | * | 12/1989 | Debetencourt | 215/250 |
| 5,833,123 A | * | 11/1998 | Gueret | 222/153.06 |
| 5,979,681 A | * | 11/1999 | PatrickJean-Luc Andre et al. | 215/216 |
| 6,347,716 B1 | * | 2/2002 | Nofer et al. | 215/235 |

FOREIGN PATENT DOCUMENTS

DE 19824714 4/1999

* cited by examiner

*Primary Examiner*—Gene Mancene
*Assistant Examiner*—Patrick Buechner
(74) *Attorney, Agent, or Firm*—Martin A. Farber

(57) ABSTRACT

A closure (V) for a vessel, such as a bottle (1), having a closure cap and a closure lower part, tamper proofing (37) being provided, having a securing part which, on first use, can be displaced into a position which clearly indicates that the vessel has been opened, and, to achieve a simple structure which is reliable in use, the securing part comprises a securing projection (38) which passes freely through the closure cap and is secured to the closure lower part, and the securing projection, to destroy the tamper proofing can be pressed into the closure lower part, and latching elements, which interact in the manner of barbs with the pressed-in securing part, are formed in the closure lower part.

10 Claims, 3 Drawing Sheets

V
x
6
y
31
32
34
35
7
a
b
33
1
10
10
z
30
30
2
29
36
17
19
α
20
14
21
39
18
41
15
40
27
13
5
37
28
26
25
3
38
9
4
24
y
x
11
8
42
43
12
16
24
23

TILTING NOZZLE CAP WHICH CAN BE ALLOCATED TO A CONTAINER

FIELD AND BACKGROUND OF THE INVENTION

The invention relates to a tilting nozzle cap which can be associated with a vessel and has an outer part and an inner part, the inner part closing off an outlet opening in the outer part in a basic position and opening up the outlet opening in a tilted position, so that substance which passes to an entry level is discharged via passage openings, the inner part also being displaced backward relative to the outer part in the tilted position, and moreover the inner part being held in the tilting nozzle cap by means of a base.

A tilting nozzle cap of this type is known from U.S. Pat. No. 3,221,952. In that cap, the outer part can be displaced linearly, with sliding guidance, relative to the inner part, so as to open up the outlet opening in the outer part. The base which rests on the outer part is produced as a drawn-over membrane. Passing over a dead center line, both limit positions are thereby, as it were, "latched". Furthermore, this so-called push-pull cap can be used as a tilting nozzle cap as a result of lateral pressure being exerted on the outer part from the closed basic position. In the process, the base, which is in the form of an annular membrane, lifts off on the side to which the load is applied. It pushes forward the outer part with respect to the inner part, which has a closure pin. In this way, the outlet opening is opened up. The closure pin lies laterally in front of the entrance to this opening. The closure pin rests on a base plate of the tilting nozzle cap, which is associated under the position of the passage openings. The closure pin also executes the curved movement.

SUMMARY OF THE INVENTION

It is an object of the invention to provide a tilting nozzle cap of the generic type in a manner which is structurally simple yet reliable in use.

This object is achieved, firstly and substantially, by a tilting nozzle cap, in which it is provided that the base is in a pivot-like form, and that there is an entry level of the inner part in the tilted position. This simplifies the structure of a dispensing head of this type. The base plate can be dispensed with. There are no bent sections of the functional parts increasing the friction. The linearity of the cap part also rules out any form of strand distortion; rather, there is a balanced feed of the substance which is to be dispensed to the outlet opening. Forming the base in the manner of a pivot localizes the change in direction to a spatially small region, rather than this change in direction taking place in a zone of overlapping guides for functional parts. The entry plane is for the first time present in the tilted position of the inner part. The corresponding element can, for example, punch open the path to the substance which is to be dispensed. It is then advantageous if the base has a circumferential corrugated structure. This leads to a configuration which is excellent in terms of tilting but has to be produced deliberately. If a specific discharge direction is desired on account of the corresponding configuration of the vessel, this can be achieved structurally by simple means. This is embodied by the fact that the corrugated structure is not formed in a tongue-like radial portion, or at least at the radial edge boundaries thereof, in order to define a preferred tilted position. Furthermore, an advantageous feature consists in the fact that the entry level is drawn into the vessel interior relative to the base. This can be used to form a type of tear-open claw. This can be incorporated without problem in the underfloor region of the base by forming the base frustoconically in the basic position. This leads to a type of dome. The measure according to which a planar base portion adjoins the frustoconical construction on the radially outer side is favorable in terms of the securing technology. The planar base portion forms the stabilizing basis for the frustoconical base. In connection with the tear-open claw, it is also advantageous if the portion of the entry level which is drawn into the vessel interior forms a sharpened edge. In this way it is possible, for example, to open a product-protecting sealing film or foil when the vessel is first used. A sealing film or foil of this type is supported by the end edge of the neck of the vessel. The measure according to which the edge is provided with teeth has proven to assist this opening process. The result is a type of toothed ring. The exposed teeth tear open the film or foil and thus prepare the perforated cut. It is then provided for the inner part to be formed as a passage tube and for a closure pin to be secured in the interior of the passage tube, leaving passage openings between an inner wall of the passage tube and the outer wall of the closure pin. These elements which leave clear passage openings are expediently radial cross-pieces. To make the corresponding dispenser particularly easy to operate, it is also proposed for the inner part to be held latched in the tilted position. In this case, it is favorable for the outer part to have a guide wall which interacts with an outer wall of the passage tube. Furthermore, an advantageous feature of the invention consists in the fact that the guide wall is, at the same time, formed as a guide tube and that a latching projection, which the passage tube has to run over in order to reach the latched tilting position, is formed on an inner surface of the guide. This latching device can be taken account of directly in terms of molding technology, without the need for additional components. With a view to achieving appropriate actuation, it has proven useful for the outer part to have a molded actuating feature, which, in the radial direction, is formed in a region which covers the tongue-like radial portion. The radial portion acts as a reinforcing cross-piece, whereas the diametrically opposite region is more yielding, on account of the corrugated structure. The result is an oriented tilting by means of the outer part. A molded actuating feature which is advantageous in terms of the grip provided is achieved if this feature is produced as an actuating recess. The latter solution takes account of the space required for a fingertip. Overall, the tilting displacement of the outer part does not lead to excessive transverse displacement with respect to the vessel if the outer part is for the most part—apart from its actuating recess—formed as a convexly curved cap. It is possible for there to be a body which is rotationally symmetrical in the manner of a hyperbola. It is then provided for the outer part to be connected to the inner part in a pivotally-movable manner. The connection expediently lies in the region of the base. To promote or ensure cohesive guidance despite the tilting displacement, it is proposed that a guide shield, which is lengthened by the radian measure of the tilting angle of the outer part, projects beyond the base of the inner part on the opposite side from the pivot point. Finally, an advantageous feature of the invention is that the inner part can be held at a mouth of a neck of the vessel. Finally, for safety of use, it is of benefit for the basic position to be tamperproofed.

BRIEF DESCRIPTION OF THE DRAWINGS

The subject matter of the invention is explained in more detail below with reference to an exemplary embodiment which is illustrated in the drawing, in which.

DETAILED DESCRIPTION OF THE PREFERRED EMBODIMENT

Figure 1:
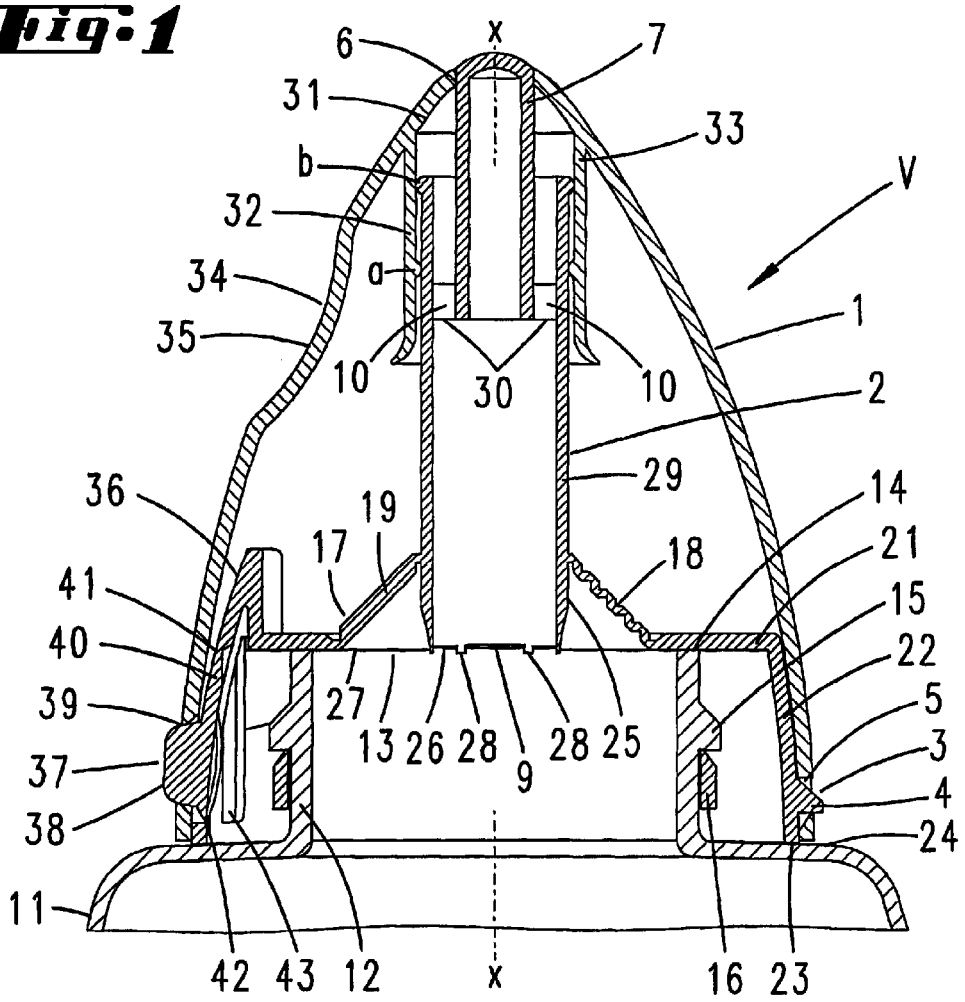
FIG. 1 shows the tilting nozzle cap according to the invention in vertical section, on an enlarged scale, in the basic position.
Figure 2:
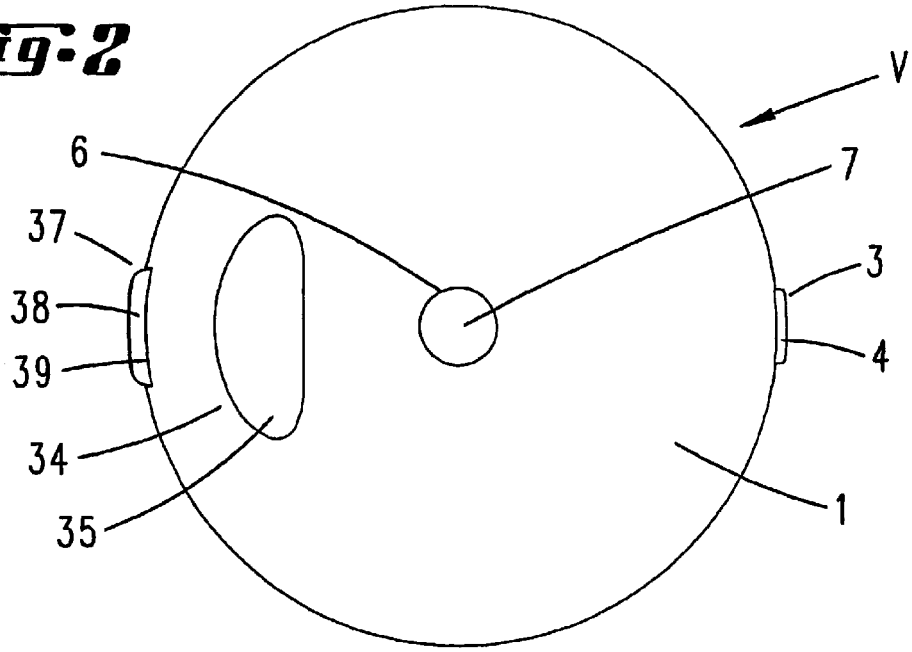
FIG. 2 shows the plan view thereof.

The tilting nozzle cap V illustrated is of two-part structure. It comprises an outer part 1 and an inner part 2. The outer part 1 is associated with the inner part 2 in a tiltably-movable manner. The correspondingly pivotally-movable association can be seen from FIGS. 1 and 3.

The pivot point 3 provided for this purpose can be produced by means of an integral hinge—with the advantage of the cap being of single-part structure—or, as illustrated, by means of an anchoring lug 4 of the inner part 2, which anchoring lug 4 engages in a bearing eyelet 5 of the outer part 1.

The anchoring lug 4 therefore allows a snap-together association.

The outer part 1, which is shaped in the form of a sugarloaf, i.e. is for the most part curved convexly, functions as the cap which engages over the inner part 2 in the manner of a dome. At the highest point, centrally located, it has an outlet opening 6, which is kept closed by the inner part 2 in the basic position (of. FIG. 1) of the tilting nozzle cap V. By contrast, in a tilted position of the tilting nozzle cap V, a relative movement of the parts 1, 2 with respect to one another leads to the outlet opening 6 being opened up as a result of a closure pin 7 being displaced backward. Therefore, by means of a plunging orientation of the tilting nozzle cap V, substance 8 passing via passage openings 10 in the inner part 2 can be discharged via an entry level 9. The substance 8 is in the form of liquid material through to a pasty mass.

The substance 8 which is to be dispensed is accommodated in a vessel 11 in the form of a bottle. It may be a squeezable bottle. The vessel 11 continues in the form of a centrally located neck 12, the mouth 13 of which ends at a horizontal end face 14 of the annular neck 12.

At a spacing from the exposed end face 14 of the neck 12, a latching projection 15 extends on the lateral-wall side thereof. This projection, on the top side, slopes obliquely downward toward the outside and allows a ring 16 which is capable of radial expansion to slide over it. This ring, as a result of being elastically restored, using a corresponding reserve length of the ring 16, latches beneath a horizontal flank of the lug-like latching projection 15. The ring 16 starts from the underside of a base 17 of the inner part 2. It rests on arms connected thereto. Further details can be found in DE 198 24 714 A1. The content of disclosure of this application is hereby incorporated in its entirety, partly for the purpose of including features described in these documents in claims of the present application.

The inner part 2 is held in the tilting nozzle cap V by means of the base 17. It (17) rests on the end face 14 and, in the inner area of the region which circumscribes the mouth 13, is formed in the manner of a pivot with respect to a partial portion of the inner part 2.

The base 17, which is formed in the manner of a pivot, has a circumferential corrugated structure 18. The corrugations of this structure are disposed so as to run concentrically with respect to a longitudinal center axis x—x of the tilting nozzle cap V. The corrugations are identical to one another. They promote the desired tilting of the partial portion of the inner part 2.

Figure 5:
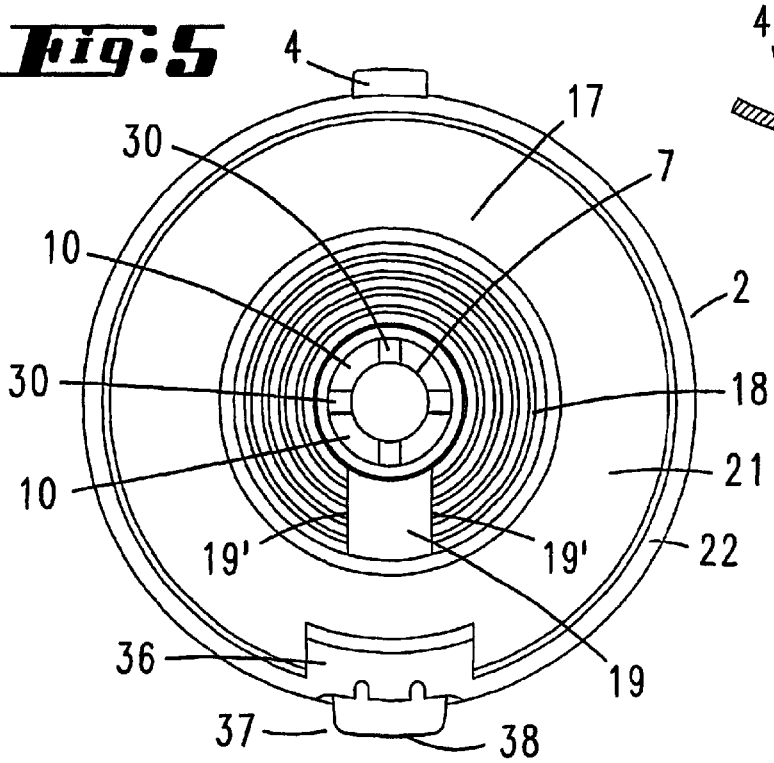
FIG. 5 shows the plan view thereof.

The tilting direction can be predetermined by simple means, which means consist in the corrugated structure 18 being interrupted by a partial reinforcement. The reinforcement forms a tongue-like radial portion 19. Reference should be made to FIG. 5. It can be seen that the corrugations end before the edge boundaries 19' thereof. During tilting, the zone of the corrugated structure 18, which forms, as it were an annular membrane, kinks up in the diametrically opposite position to the tongue-like radial portion 19, in crease-forming manner. The crease is provided with the reference 20.

The entry level 9 of the inner part 2 is drawn into the vessel interior relative to the base 17. In the basic position, the base 17 adopts a uniform frustoconical form. Reference should be made to FIG. 1. When the tilting position which opens up the outlet opening 6 is being executed (FIG. 3), the entry level 9 of the inner part 2 penetrates into the neck 12. By contrast, in the basic position, this entry level 9 ends at the same height as the end face 14 of the neck 12. Radial migration of the entry level 9 in the tilting direction is superimposed on a tilting movement. The tilted position is marked as y—y. This axis includes an angle $\alpha$ of approx. 12° with the longitudinal center axis x—x. The lines x—x, y—y intersect one another in the lower region of the neck 12. The tilting direction is indicated by z.

At the bottom side, i.e. at the bottom of the truncated cone, the frustoconical shape of the base 17 merges into a planar base portion 21. This portion extends horizontally, and its underside lies on the end face 14 of the neck 12, if appropriate with a seal in between. The ring 16 exerts a pulling stress on the inner part 2 in the direction of the vessel 11.

The planar base portion 21 continues, on the side remote from the outlet opening, into a cup-shaped pedestal 22, the pedestal rim 23 of which rests on a shoulder 24 of the vessel 11. At least the lateral wall of the pedestal 22 runs conformly with respect to the rotationally symmetrical, hyperbolic shape of the wall of the outer part 1.

The free movement on the side which lies diametrically opposite the pivot point 3, required for tiltability of this outer part 1, is taken into account in guidance terms.

The part which lies in the upper region, of smaller diameter, of the frustoconical base 17 has a portion 25 which is drawn toward the vessel interior and, at its free end, forms the entry level 9. This free end is produced as a sharpened edge 26. A cutting edge 26 of this type can be used to break a sealing film or foil 27 which is drawn over the end face 14 in the manner of the skin of a drum and is held on this end face. This breaking takes place during the tilting movement, and continues as a superimposed transverse tearing. The edge 26 also has teeth 28, which produce a type of toothed ring which assists with the removal of the seal.

The portion 25 is the base-underside part of a passage tube 29 of the inner part 2. This tube includes, in its end region which is remote from the vessel, the closure pin 7. The external diameter of the latter is dimensioned in such a way that the passage openings 10 mentioned above are left between the inner wall of the passage tube 29 and the outer wall of the closure pin 7. These openings are produced by means of cross-pieces 30 which span the annular gap created between the said walls. In this respect, the securing is effected at the bottom of the relatively long closure pin 7, so that the protruding stopper portion itself has a certain mobility. The inner side of the tip of the outer part 1 in practice forms an entry-guidance funnel 31 for the externally convexly rounded head of the closure pin 7.

The outer part 1 has a guide wall 32 which interacts with the outer wall of the passage tube 29. This wall is at the same time configured as a guide tube 33, forming, together with the passage tube 29 of the inner part 2, a telescopic tube. The guide tube 33 is positioned directly behind the entry-guidance funnel 31 and widens out at its free end. This assists with the plug-fitting of the tube parts.

Figure 3:
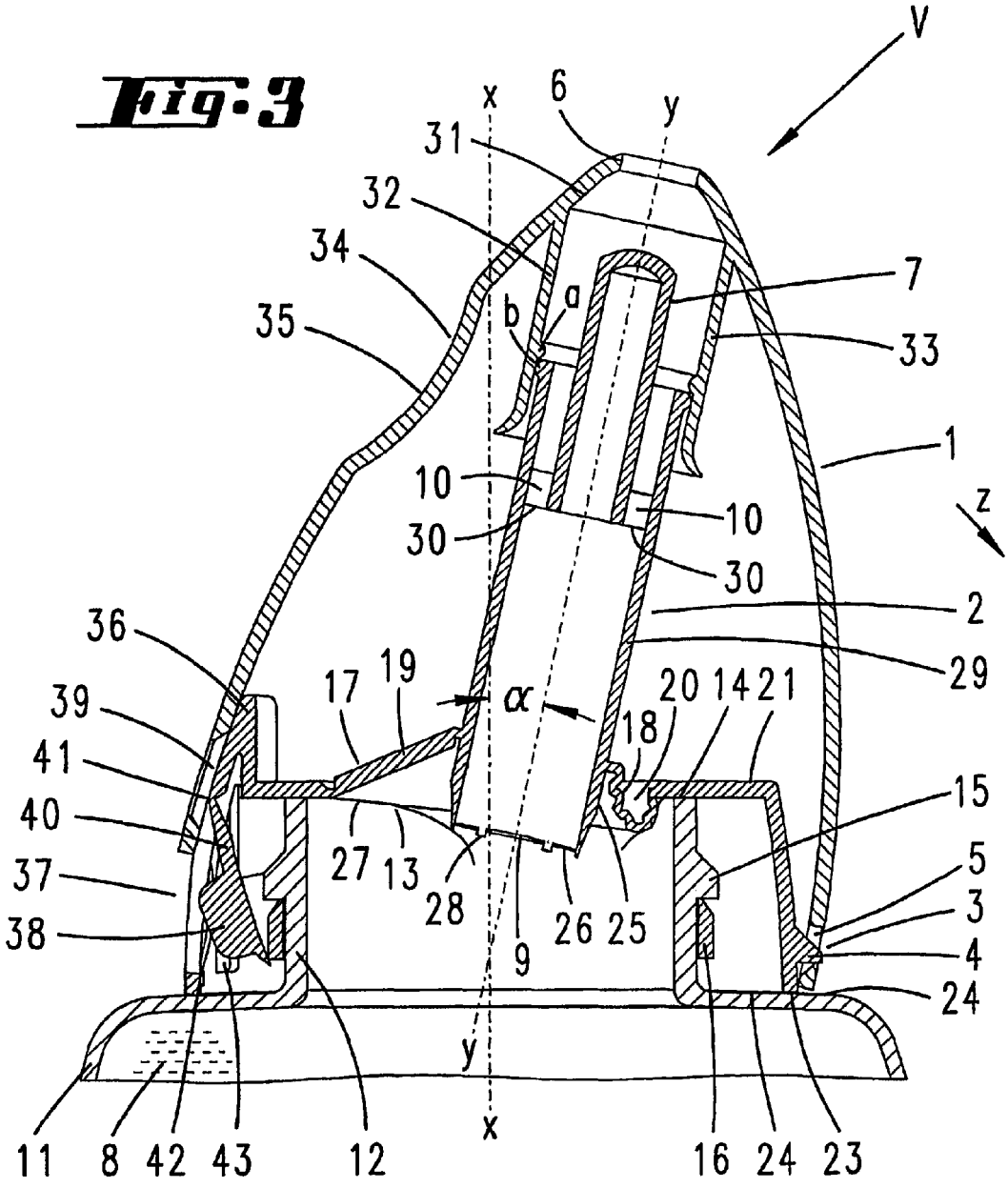
FIG. 3 shows the tilting nozzle cap in the tilted position in which it opens up the outlet opening, likewise in vertical section.
Figure 4:
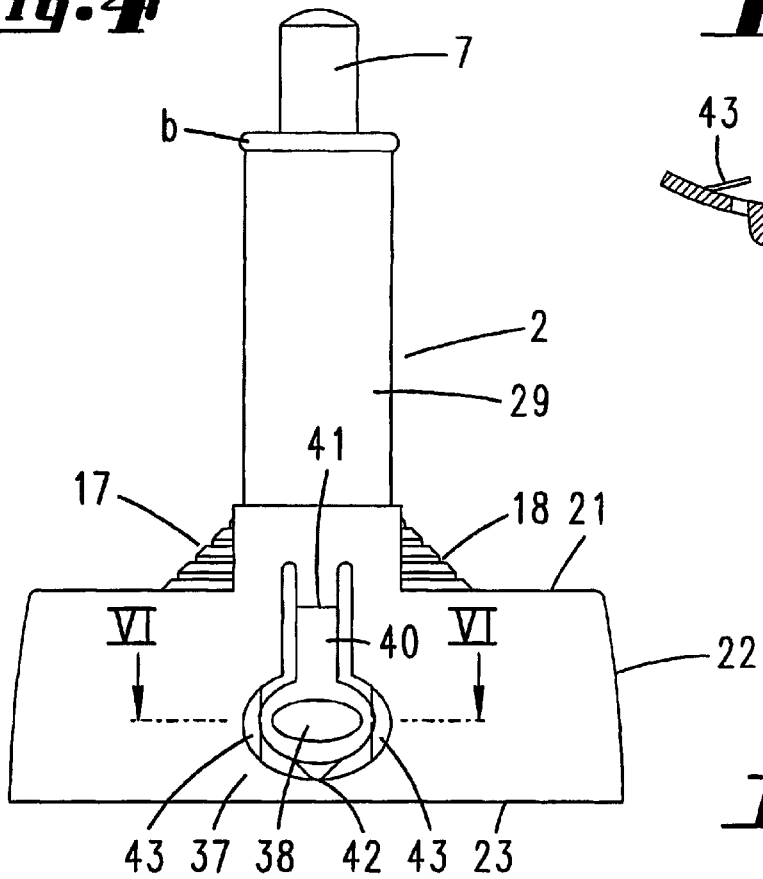
FIG. 4 shows the inner part in an isolated view.
Figure 6:
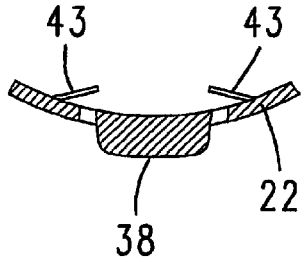
FIG. 6 shows the section according to line VI—VI in FIG. 4, showing tamperproofing means in the basic position.
Figure 7:
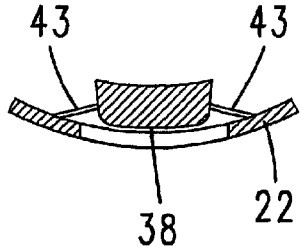
FIG. 7 shows the same section after the tamperproofing means have come into operation.

The inner part 2 is held latched in the tilted position (FIG. 3). Consequently, when the tilting nozzle cap V is opened, the substance 8 can be discharged without the outer part 2, which functions as the actuating member, having to be continuously held in the tilted position.

The corresponding latched holding is achieved by the fact that a latching projection a is formed on an inner surface of the guide wall 32. The passage tube 29, i.e. the free end of the latter, can run over this projection in order to reach the latching tilted position. This free end bears a mating latching projection b, arranged on the outer wall of the passage tube 29. The snap-action closure produced in this way can readily be overcome again in order for the tilting nozzle cap V to be closed again (cf. FIG. 1).

For actuation of the tilting nozzle cap V, the outer part 1 of the latter has a molded actuating feature 34. The latter is produced as an actuating recess 35, interrupting the convexly curved cap shape of the outer part 1, which is otherwise uniformly present. The recess 35 is of such a shape and orientation that the tip of a finger of the actuating hand can be comfortably positioned therein. It (35) extends in the upper third, i.e. at a distance from the pivot point 3 which is favorable for tilting. In spatial terms, it is situated in the covering region which is radially aligned with the tongue-like radial portion 19 of the inner part 2. Therefore, the actuating force, with a view to a steering pivoting movement of the tongue-like radial portion 19, passes around its peripheral attachment toward the planar base portion 21. The corrugated zone, i.e. the corrugated structure 18, in the process passes, in the diametrically opposite position, into the crease 20 described, on account of the basic construction of the base 17, which is formed in the manner of a pivot. Consequently, in the tilted position which is reached, the unsealed entry level 9 of the inner part 2 is reliably produced. Despite the tilting movement with a view to achieving a lateral discharge opening of the container, the desired guidance conditions between outer part 1 and inner part 2 are produced to an optimum degree. The gating edge zone, remote from the pivot point 3, is still maintained in guidance terms and is structurely refined in this respect. This is embodied by the fact that a guide shield 36, which is lengthened at least by the radian measure of the tilting angle of the outer part 1, projects beyond the top side of the base 17, or more specifically its planar base section 21 of the inner part 2, on the opposite side from the pivot point 3. As illustrated in FIG. 3, the edge of the cap is supported on this guide shield 36, specifically both above the level of the base portion 21 and below the latter, since the shield also merges into the wall of the pedestal 22 which is bent in the same way.

The tilting nozzle cap V has tamperproofing means, which is denoted by 37. It has a latching head 38. This projects into an aperture 39 in the region of the cap which is close to the edge. The latching head 38 rests on a tongue 40, which is held on the inner part 2 by means of an integral hinge 41. Apart from a desired breaking point 42 and the material bridge which forms the integral hinge 41, the tongue 40 and latching head 38 are cut clear. The desired breaking point 42 lies well away from the integral hinge 41.

During initial use, i.e. during enabling of the tilting displacement of the outer part 1 about the pivot axis 3, the latching head 38 is depressed so that the path becomes clear. The latching head 38 in the process gets caught behind barrier strips 43 of the inner part 2, which yield in such a manner that they are able to spring back. In this way, the user can recognize that initial use has taken place.

Mounting can take place by fitting on the cap edge of the outer part 1 on the left-hand side and then by sliding the cap edge over the back of the anchoring lug 4 on the right-hand side, until ultimately the lower edge of the bearing eyelet in the outer part 1 engages beneath the anchoring lug 4.

Then, the pre-assembled unit obtained in this way is associated with the neck 12 of the bottle by being pushed on.

I claim:

1. A closure (V) for a vessel, such as a bottle (1), comprising a closure cap and a closure lower part, tamper proofing means (37) being provided, having a securing part which, on first use, is displaceable into a position which clearly indicates that the vessel has been opened, wherein the securing part comprises a securing projection (38) which passes freely through the closure cap and is secured to the closure lower part, wherein the securing projection, in order to eliminate tamper proofing, is pressable into the closure lower part, and wherein latching elements, which interact in a manner of barbs with the pressed-in securing part, are formed in the closure lower part.

2. The closure according to claim 1, wherein the securing projection (38) is only depressable by hand deliberately.

3. The closure according to claim 1, wherein the securing projection (38) is formed such that, by a push-button section, in a tamper proofing condition, it projects beyond a surrounding outer surface.

4. The closure according to claim 1, wherein the securing part forms a lug for interaction with the latching elements.

5. The closure according to claim 1, wherein the securing part, in a cross section perpendicular to a pivot plane, is formed so as to taper outwards.

6. The closure according to claim 1, wherein the latching elements are formed as vertical strips (43) facing into interior of the cap.

7. The closure according to claim 6, wherein a free edge of a vertical strip (43) forms an overlap, which is travelable over, with respect to a movement region of the securing part.

8. The closure according to claim 1, wherein the securing part (19), in a tamper proofing condition, is connected to the closure lower part both via an integral hinge (41) and via a desired breaking point (42).

9. The closure according to claim 8, wherein the integral hinge (41) and the desired breaking point (42) are formed on opposite sides with respect to the securing projection (38).

10. The closure according to claim 8, wherein the securing part is of elongated form, and the integral hinge (41) and/or the desired breaking point (42) are formed on a narrow side.

* * * * *